US005331803A

United States Patent [19]

Shekleton

[11] Patent Number: 5,331,803

[45] Date of Patent: Jul. 26, 1994

[54] METHOD OF OBTAINING A DESIRED TEMPERATURE PROFILE IN A TURBINE ENGINE AND TURBINE ENGINE INCORPORATING THE SAME

[75] Inventor: Jack R. Shekleton, San Diego, Calif.

[73] Assignee: Sundstrand Corporation, Rockford, Ill.

[21] Appl. No.: 384,165

[22] Filed: Jul. 24, 1989

[51] Int. Cl.[5] ..... F02C 3/30

[52] U.S. Cl. ..... 60/39.36; 60/758; 60/748

[58] Field of Search ..... 60/39.06, 39.36, 760, 60/748, 758, 757

[56] References Cited

U.S. PATENT DOCUMENTS

| | | | |
|---|---|---|---|
| 2,531,810 | 11/1950 | Fyffe | 60/44 |
| 2,540,902 | 2/1951 | Moore | 60/41 |
| 2,930,193 | 3/1960 | Jaramillo | 60/39.65 |
| 2,956,404 | 10/1960 | Kassner et al. | 60/39.71 |
| 3,266,250 | 8/1966 | Freeman et al. | 60/39.36 |
| 3,285,006 | 11/1966 | Freeman et al. | 60/39.36 |
| 3,303,643 | 2/1967 | Beardsley | 60/39.02 |
| 3,381,471 | 5/1968 | Szydkowski | 60/39.65 |
| 3,613,360 | 10/1971 | Howes | 60/755 |
| 3,826,082 | 7/1974 | Smuland et al. | 60/39.65 |
| 3,869,854 | 3/1975 | Bunn | 60/39.65 |
| 3,937,013 | 2/1976 | Aspinwall | 60/39.36 |
| 4,151,709 | 5/1979 | Melconian et al. | 60/39.36 |
| 4,693,073 | 9/1987 | Blackburn | 60/39.02 |

*Primary Examiner*—Michael J. Carone

*Attorney, Agent, or Firm*—Wood, Phillips, VanSanten, Hoffman & Ertel

[57] ABSTRACT

Undesirable high temperature gradients associated with inadequate mixing of dilution air with gases of combustion in turbines is avoided in a structure wherein dilution air is injected with a high degree of circumferential swirl through an opening (50) to the interior of an annular combustor (20) at the outlet (36) thereof which is connected to a turbine nozzle (46). The high circumferential swirl generates high "g" forces causing rapid penetration of the dilution air in the radial direction through the combustion air stream and the length of the path of the combined stream, and thus residence time and thoroughness of mixing, can be controlled through the use of a baffle (60) overlying the opening (50) to direct the dilution air countercurrently to the gases of combustion prior to introduction into the stream thereof.

13 Claims, 1 Drawing Sheet

METHOD OF OBTAINING A DESIRED TEMPERATURE PROFILE IN A TURBINE ENGINE AND TURBINE ENGINE INCORPORATING THE SAME

FIELD OF THE INVENTION

This invention relates to turbine engines, and more particularly, to the achieving of desired temperature profiles in the nozzle and/or turbine wheel sections of such engines.

BACKGROUND OF THE INVENTION

Large temperature gradients and high operating temperatures in those parts of turbine engines subjected to gases of combustion have long been known to be undesirable. High temperatures may require the use of exotic materials in constructing turbine components in order to withstand thermal fatigue and the use of such material substantially increases the cost of building a turbine. Large temperature gradients are undesirable because the large internal stresses that are generated when one part of a component operates at one temperature and another part operates at a substantially different temperature due to the difference in thermal expansion.

Consequently, it is customary to inject so called "dilution air" into the gases of combustion prior to their application to the turbine wheel and the nozzle which directs the gases thereat. Typically, it is desired to achieve a uniform circumferential mixing of the dilution air with the gases of combustion which produces a specific shape of radial temperature profile at the turbine wheel inlet which is usually not flat. However, in an optimal case, there will be complete mixing of the dilution air with the gases of combustion such that a uniform temperature of a stream of combined gases of combustion and dilution air is achieved. When such occurs, the operating temperature of the components can be adequately regulated by controlling, through suitable design parameters, the amount of dilution air in proportion to gases of combustion. At the same time, temperature gradients will be nonexistent because all parts of the gas stream being applied to the nozzle, and thus to the turbine wheel, will be at equal temperatures.

Perfect circumferential mixing cannot be obtained in practice although it may be approached in large sized turbines wherein the size of the components is such that there is substantial residence time of combustion gases and dilution air in a combustor or the like prior to application to a nozzle so as to allow fairly thorough mixing. However, in small scale turbines, the residence time is extremely short and adequate mixing will not necessarily occur without undesirably increasing the size of the components.

The present invention is directed to overcoming one or more of the above problems.

SUMMARY OF THE INVENTION

It is the principal object of the invention to provide a new and improved turbine engine wherein the difficulties caused by high temperature gradients and/or high operating temperatures may be avoided. It is also an object of the invention to provide a method whereby a desired temperature profile across a nozzle and/or turbine wheel in a turbine may be obtained. It is a further object of the invention to provide means for controlling a turbine inlet radial temperature profile while assuring a uniform circumferential turbine nozzle inlet temperature profile with minimal pressure loss in a very short length.

An exemplary embodiment of the invention achieves the foregoing object in a turbine engine including a rotor rotatable about an axis and which includes a turbine wheel section adapted to receive gases of combustion and be driven thereby. An annular combustor is disposed about the axis and has an upstream combustion zone and a downstream outlet. An annular nozzle is disposed about and directed at the turbine wheel and is connected to the outlet of the combustor. Means are provided for introducing dilution air into the combustor at a cooler temperature than the gases of combustion therein and at a location immediately upstream and radially inwardly of the outlet. The introducing means further introduces the dilution air in a stream swirling in the circumferential direction about the axis. A baffle is provided on the radially inner side of the outlet and extends generally axially toward, but not to, the upstream combustion zone to overlie the introducing means to thereby increase the length of the path the swirling stream of solution air must travel to move from the introducing means to the nozzle such that the centrifugal force acting on the cooler dilution air will cause the same to move radially outwardly through the gases of combustion to mix thoroughly therewith prior to application to the nozzle.

In one embodiment of the invention, the turbine wheel section is a radial flow turbine wheel section and the nozzle directs the gases of combustion radially inwardly.

According to this facet of the invention, a rear turbine shroud is provided for the radial flow turbine wheel section and the nozzle includes vanes mounted to the shroud on one side thereof and the baffle extends from the shroud on the other side thereof.

Preferably, the baffle has a free tip oppositely of the shroud and the free tip is rounded or curved.

In a highly preferred embodiment, wherein the baffle is mounted to the shroud, the interface of the baffle and the shroud is also curved.

A highly preferred embodiment contemplates that there be a compressed air chamber of an annular shape that generally surrounds all of the combustor except for the outlet and is adapted to receive air from a compressor. The chamber has an opening that extends into the combustor past the outlet and on the radially inner side thereof. The swirl imparting means are disposed within the chamber for causing a swirling motion about the axis to be imparted to air flowing through the chamber and a baffle is disposed to overlie the opening of the chamber to the combustor so that the swirling air entering the combustor therefrom is directed axially away from the outlet and toward, but not to, the upstream combustion zone.

According to this embodiment of the invention, the swirl imparting means comprise vanes in the chamber which extend between the combustor and a shroud.

Preferably, the baffle is an integral, generally axially directed extension of the shroud.

Another facet of the invention contemplates a method of obtaining a desired temperature profile across an annular nozzle and/or the vanes of a turbine wheel driven about an axis by gases of combustion. The method includes the steps of (a) flowing gases of combustion, which are preferably swirling, in an annular stream with an axial component toward the nozzle, and (b) introducing dilution air, which is preferably swirling, at a temperature lower than the gases of combustion from the interior of the stream with a predetermined swirling velocity about the axis so that the resulting centrifugal force on the dilution air will cause the dilution air to move radially outwardly and across the stream to mix therewith to the degree required to obtain the desired temperature profile.

In one embodiment of the invention, the method includes the further step of (c) locating the point on the stream in relation to the nozzle whereat step (b) is performed to achieve a desired mixing time during which the dilution air is introduced into the stream and prior to the application of the combined gases of combustion and dilution air to the nozzle. According to this embodiment of the invention, step (c) may be performed with a baffle which directs the dilution air countercurrently to the stream to the point of introduction.

The invention also contemplates that the predetermined swirling velocity be achieved by placing vanes in the dilution air at a desired angle to create the predetermined swirling velocity.

The invention also contemplates that the dilution air be caused to swirl by placing vanes therein and that step (b) be performed by passing the dilution air through the vanes with a sufficient drop in static pressure to generate the predetermined swirling velocity.

Other objects and advantages will become apparent from the following specification taken in connection with the accompanying drawings.

DESCRIPTION OF THE INVENTION

DESCRIPTION OF THE PREFERRED EMBODIMENT

Figure 1:
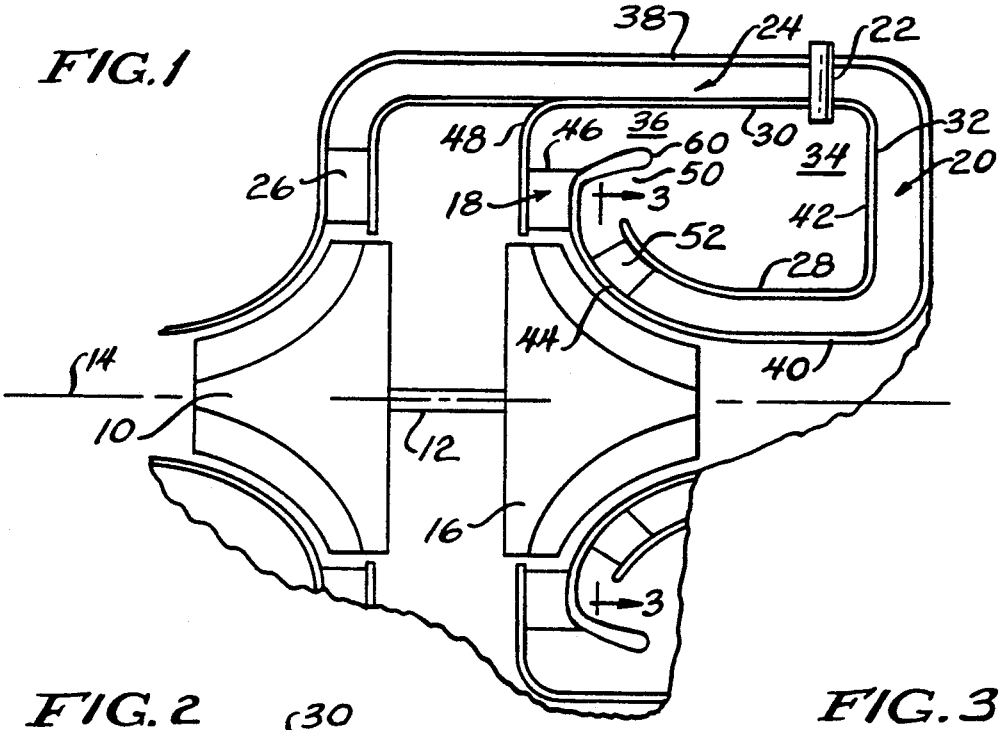
FIG. 1 is a fragmentary, sectional view of a turbine engine made according to the invention.

An exemplary embodiment of a turbine made according to the invention is illustrated in the drawings in the form of a radial turbine. However, it should be understood that the invention is not so limited. That is to say, the invention may find utility in axial turbines as well.

With reference to FIG. 1, the turbine includes a rotary compressor 10 on one end of a shaft 12 journaled for rotation about an axis 14 by bearings (not shown). Oppositely of the compressor 10, the shaft 12 mounts a rotary turbine wheel of the radial flow type which is given the reference numeral 16. The turbine also includes an annular nozzle 18 which directs hot gases of combustion at the turbine wheel 16 to drive the same. The nozzle 18 is provided with gases of combustion by a combustor, generally designated 20, which is provided with fuel by a plurality of fuel injectors 22 (only one of which is shown) and which receives combustion air from a plenum, generally designated 24.

The plenum 24 is provided with combustion air by the compressor 10 via a diffuser 26. More specifically, the combustor 20 is an annular combustor having spaced, radially inner and outer walls 28 and 30 respectively which are connected on one end by a radially extending wall 32 to define a combustion zone 34 which is upstream of an outlet area 36 connected to the nozzle 10.

The plenum 24 is defined by the walls 28, 30, 32 and additional walls including a radially outer wall 38 spaced from the wall 30, a radially inward wall 40 which is located inwardly of the wall 28, and radially extending wall 42 which is spaced axially from the wall 32. It is to be particularly observed that the plenum extends entirely about the combustor 20 except for the outlet 36. It is also to be observed that in this particular vicinity, the plenum or chamber is in part defined by the rear turbine shroud 44 for the turbine wheel 16. The rear turbine shroud 44 also serves to mount a plurality of vanes 46 (only one of which is shown) which define the nozzle 18 along with a front turbine shroud 48. As can be seen in FIG. 1, the plenum or chamber 24 opens at 50 to the interior of combustor 20. The location 50 is immediately adjacent the outlet 36. The construction is such that compressed air from the compressor 10 is introduced through the opening 50 into the combustor 34 to serve as dilution air for the gases of combustion therein. The construction is further such that a very high percentage of the dilution air introduced into the combustor 34 is introduced through the opening 50. Consequently, it flows entirely about the combustor 20 and provides excellent cooling for the walls 28, 30 and 32. In addition, in the type of turbine shown in the drawings, it provides excellent cooling for the rear turbine shroud 44.

As can be seen in the various figures, supported between the rear turbine shroud 44 which forms part of the chamber or plenum 24 and the wall 28 are a plurality of swirl imparting vanes 52. The vanes 52 have an angle A (FIG. 3) to a radius 56 extending from the axis 14 and thus cause the air moving out of the opening 50 to swirl circumferentially about the axis 14 as illustrated by arrows 58 appearing in FIG. 3.

Figure 2:
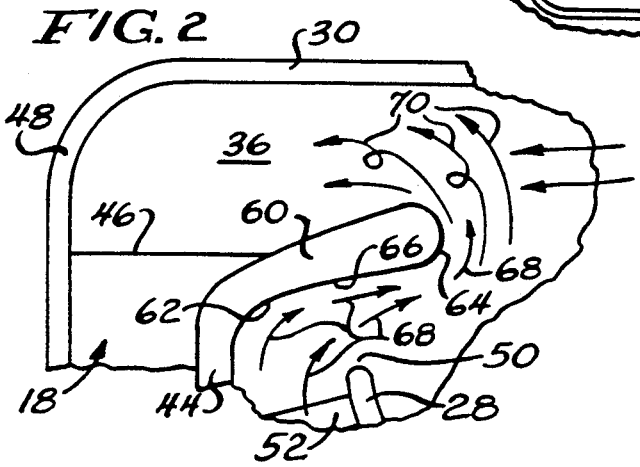
FIG. 2 is a fragmentary, enlarged sectional view of part of the turbine engine.

As seen in both FIGS. 1 and 2, the invention includes a baffle 60 which may be in the form of a lip that is integral with the rear turbine shroud 44 at the radially outer extremity thereof. The baffle 60 is directed axially toward the upstream combustion zone 34 and away from the outlet 36. At its interface 62 with the turbine shroud 44, there is a generous curve. Its free end 64 is likewise generously rounded or curved.

In considering operation of the apparatus, it should be considered that the swirl imparted to the dilution air entering the combustor 20 through the opening 50 develops a high centrifugal force in such air which may be many thousands of "g's". Thus, the stream of dilution here will attach itself to the curve 62 and the radially inner side 66 of the baffle 60 and adhere to the rounded tip 64 as as well, all as shown by arrows 68 in FIG. 2.

At the tip 64, the dilution air, still swirling circumferentially, enters the flow of combustion gas from the combustion zone 34 which will be flowing with an axial component, and preferably with some swirl as well, with all swirl typically in the same direction. At this point in time, the dilution air will be substantially cooler than the hot gases of combustion and consequently much more dense. Generally, it is desirable to have a high degree of swirl in the hot gases of combustion. However, in any case, the dilution air is readily able to penetrate the stream and move radially outwardly because of the high "g" forces acting upon it and its greater density, all as indicated by arrows 70 in FIG. 2. As a consequence, extremely thorough mixing across the entirety of the cross-section of the stream of combustion gas is achieved.

Figure 3:
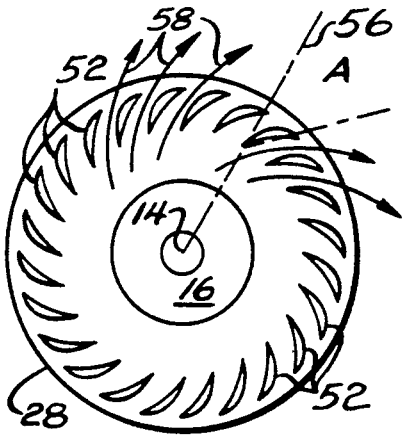
FIG. 3 is a sectional view taken approximately along line 3—3 in FIG. 1.

In order to assure sufficient residence time prior to application to the nozzle 18, the length of the baffle 60 in the direction of the combustion zone 34 may be suitably regulated. The longer the baffle, the more time is available for mixing. However, it is to be specifically observed that the degree of mixing can be controlled by other factors as well. For example, by controlling the angular velocity or swirl velocity of the dilution air, the centrifugal force acting upon the same, and thus the rate of penetration through the stream of combustion air, can likewise be controlled. The angular velocity may be adjusted by suitably selecting the swirl angle "A" as illustrated in FIG. 3. Alternatively, it can be influenced substantially by the drop in static pressure across the vanes 52, a higher drop, of course, generating higher velocities.

From the foregoing paragraph, it will be appreciated that the invention provides an optimal means of assuring good mixing of dilution air with the gases of combustion so as to achieve a desired temperature profile and avoid high temperature gradients and/or high temperature operation in turbine engines. The same is ideally suited for use in small scale turbine engines since the use of swirling dilution air and the "g" forces associated therewith assures rapid penetration of the dilution air into the combustion gas stream in the radial direction. Furthermore, through the use of the baffle 60, the residence time or mixing time during which the dilution air mixes with the gases of combustion prior to application to the nozzle can be increased or decreased as required without increasing the length of the combustor 20, an undesirable modification that would result in an increase in size of the overall machine.

In the preferred embodiment it will be noted that there are no deswirl vanes immediately downstream of the diffuser 26. Thus, there will be a high degree of swirl within the limits of available pressure loss in compressed air entering the combustor 20 and, in addition, the higher velocity air swirl in the plenum 24 will achieve greater cooling of the inner and outer walls 28 and 30 and the radially extending wall 32. Hence, in many instances the vanes 52 need not introduce added swirl or can provide minor optimization of swirl for air moving out of the opening 50.

Figure 4:
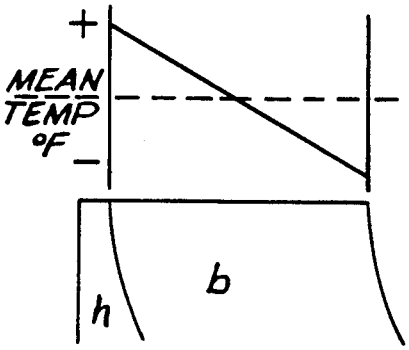
FIG. 4 is an enlarged sectional view illustrating a first temperature profile for a turbine hub and blades.
Figure 5:
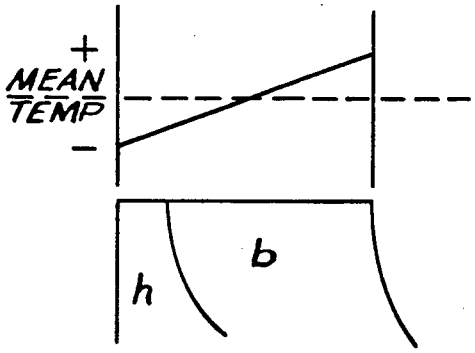
FIG. 5 is an enlarged sectional view illustrating a second temperature profile for a turbine hub and blades.

Referring to FIGS. 4 and 5, the size of the baffle 60 modifies the mixing length and, thus, the temperature profile. As a result, and for purposes of illustration, the radial temperature profile at the radially outermost point of the turbine wheel 16, i.e., at the turbine tip, will be as illustrated in FIG. 4 in the absence of the baffle 60 whereas, with a large baffle 60, the radial temperature profile will be as illustrated in FIG. 5. Generally, the radial temperature profile as illustrated in FIG. 5 will be preferred to ensure greater cooling of the hub portion "h" rather than the blade portion "b" of the turbine wheel 16.

As will now be appreciated by those skilled in the art, the exact radial temperature profile can be controlled by controlling the size and shape of the baffle 60.

With the present invention, angular momentum conservation has been achieved inasmuch as the mixing of dilution air involves little turbulence. As a result, angular momentum has been conserved and, therefore, despite high swirl velocities the pressure loss is less than normal.

I claim:

1. A turbine engine comprising:

a rotor rotatable about an axis and including a turbine wheel section adapted to receive gases of combustion and be driven thereby;

an annular combustor including radially inner and outer walls about said axis and defining an upstream combustion zone and a downstream outlet;

an annular nozzle disposed about and directed at said turbine wheel and connected to said outlet;

means for introducing dilution air into said combustor at a cooler temperature than gases of combustion therein and at a location immediately upstream and radially inwardly of said outlet, said introducing means further introducing said dilution air in a stream whirling in the circumferential direction about said axis; and a baffle on the radially inner side of said outlet in spaced relation to said inner wall and extending generally axially toward, but not to said upstream combustion zone to overlie said introducing means and into said swirling stream to thereby increase the length of the path the swirling stream of dilution air must travel to move from said introducing means to said nozzle such that centrifugal force acting on said cooler dilution air will cause the same to move radially outwardly through the gases of combustion to mix therewith prior to application to said nozzle.

2. The turbine engine of claim 1 wherein said turbine wheel section is a radial flow turbine wheel section and said nozzle directs gases of combustion radially inwardly.

3. The turbine engine of claim 2 including a rear turbine shroud for said radial flow turbine wheel section and wherein said nozzle includes vanes mounted to said shroud on one side thereof and said baffle extends from said shroud on the other side thereof.

4. The turbine engine of claim 3 wherein said baffle has a free tip opposite of said shroud, said free tip being rounded.

5. The turbine engine of claim 3 wherein the interface of said baffle and said shroud is curved.

6. The turbine engine of claims 1 wherein the end of said baffle nearest said upstream combustion zone is curved.

7. A turbine engine comprising:

a rotor rotatable about an axis and including a turbine wheel section adapted to receive gases of combustion and be driven thereby;

an annular combustor about said axis and having an upstream combustion zone and a downstream outlet;

an annular nozzle disposed about and directed at said turbine wheel and connected to said outlet;

an annular compressed air chamber generally surrounding all of said combustor except said outlet and adapted to receive air from a compressor, said chamber having an opening into said combustor at said outlet at the radially inner side thereof;

swirl imparting means within said chamber for causing a swirling motion about said axis to be imparted to air flowing in said chamber; and a baffle means overlying said opening so that swirling air entering said combustor therefrom is directed axially away from said outlet and toward said upstream combustion zone.

8. The turbine engine of claim 7 wherein said turbine wheel section is a radial flow turbine wheel section and a rear shroud in proximity thereto, said rear shroud forming part of a wall defining said chamber and being cooled by air flowing therein.

9. The turbine engine of claim 8 wherein said swirl imparting means comprise vanes in said chamber extending between said combustor and said shroud.

10. The turbine engine of claim 8 wherein said baffle is an integral, generally axially directed extension of said shroud.

11. A method of obtaining a desired temperature profile across an annular nozzle and/or the vanes of a turbine driven about an axis by gases of combustion, comprising:

(a) flowing gases of combustion in an annular stream with an axial component toward the nozzle;

(b) introducing dilution air at a temperature lower than the gases of combustion from the interior of the stream with a predetermined swirling velocity about the axis at a location adjacent the nozzle; and, (c) radially and axially containing the dilution air so that the resulting centrifugal force on the dilution air will cause the dilution air to move first countercurrent to said stream and then radially outwardly and across said stream to mix therewith to the degree required to obtain said desired temperature profile.

12. The method of claim 11 wherein said predetermined swirling velocity is achieved by placing vanes in the dilution air at a desired angle to create said predetermining swirling velocity.

13. The method of claim 11 wherein said dilution air is caused to swirl by placing vanes therein and step (b) is performed by passing the dilution air through said vanes with a sufficient pressure drop to generate said predetermined swirling velocity.

* * * * *